US005267876A

United States Patent [19]

Rupert et al.

[11] Patent Number: 5,267,876

[45] Date of Patent: Dec. 7, 1993

[54] BOARD SAVING STACKED ELECTRICAL CONNECTOR ASSEMBLY

[75] Inventors: Martha L. Rupert, Hummelstown; Robert N. Whiteman, Jr., Middletown, both of Pa.

[73] Assignee: The Whitaker Corporation, Wilmington, Del.

[21] Appl. No.: 78,906

[22] Filed: Jun. 16, 1993

Related U.S. Application Data

[63] Continuation of Ser. No. 910,055, Jul. 8, 1993, abandoned.

[51] Int. Cl.[5] ..... H01R 9/09

[52] U.S. Cl. ..... 439/540; 439/532

[58] Field of Search ..... 439/532, 540

[56] References Cited

U.S. PATENT DOCUMENTS

| | | | |
|---|---|---|---|
| 4,808,125 | 2/1989 | Waters et al. | 439/607 |
| 4,842,552 | 6/1989 | Frantz | 439/554 |
| 4,878,856 | 11/1989 | Maxwell | 439/540 |
| 4,975,067 | 12/1990 | Bastijanic et al. | 439/924 |
| 5,044,984 | 9/1991 | Mosser et al. | 439/540 |
| 5,080,609 | 1/1992 | Fabian et al. | 439/540 |
| 5,085,590 | 2/1992 | Galloway | 439/95 |

*Primary Examiner*—Gary F. Paumen

[57] ABSTRACT

A stacked electrical connector assembly 20 for mounting on a circuit board CB includes upper and lower electrical connectors 22,24 each having electrical terminals having connecting post portions 48,72 projecting from the connectors in rows. The upper and lower connectors 22,24 are supported in superposed relationship by means of metal brackets 26. The connecting post portions 72 of the lower connector 24 depend therebelow for insertion through respective holes of a group of holes 112 a circuit board CB. Each connecting post portion 48 of the upper connector 22 is connected to a corresponding connecting posts portion 72 of the lower connector 24 by means of a respective trace 98 of a flexible film cable 28 whereby the connectors 22,24 are wired in parallel for economy of board space and footprinting.

8 Claims, 4 Drawing Sheets

BOARD SAVING STACKED ELECTRICAL CONNECTOR ASSEMBLY

This application is a Continuation of Application Ser. No. 07/910,055 filed Jul. 6, 1993, now abandoned.

BACKGROUND OF THE INVENTION

This invention relates to a stacked electrical connector assembly for mounting on a circuit board and in particular to such an assembly which is saving of circuit board space.

There are described in U.S. Pat. Nos. 4,878,856, 5,044,984, 5,080,609 and U.S. Pat. No. 5,085,590, stacked electrical connector assemblies for mounting on circuit boards, each such assembly comprising upper and lower electrical connectors connected together in superposed relationship, by means of at least one bracket, each connector having at least one row of electrical terminals each having a connecting post which is to be electrically connected to circuitry on the circuit board. In each case, the connecting posts of the lower connector project from a bottom base thereof which is engaged with the circuit board. In use of the assembly the posts are inserted through respective holes of a set of holes in the circuit board and then soldered to said circuitry. According to U.S. Pat. No. 4,878,856, the connecting posts of the upper connector are mated with an extension member, which is, in fact, a further connector from which connecting posts project for insertion through a further set of holes in the circuit board for soldering to the circuitry thereon. According to U.S. Pat. No. 5,044,984, the connecting posts of the upper connector have elongate vertically extending portions which engage between teeth of a separator comb projecting rearwardly from the lower connector, for insertion through a further set of holes in the circuit board. According to the teaching of U.S. Pat. No. 5,080,609, the connecting posts of the upper connector are electrically connected by means of individual conductors of a flat flexible cable, to individual pins of a vertical pin header located rearwardly of the lower connector, the pins being inserted through the holes of a further set of holes in a circuit board. According to U.S. Pat. No. 5,085,590, the connecting posts of the upper connector are soldered to traces of an intermediate circuit board which extends vertically, the traces are in turn soldered to pins of a pin header disposed rearwardly of the lower connector, the pins being inserted through a further set of holes in the circuit board and soldered to the circuitry thereon. In the case of each of the U.S. Patents cited above, a plurality of footprints are needed on the circuit board so that a corresponding number of holes must be drilled therein and so that the connector assembly takes up a very considerable area of the circuit board.

SUMMARY OF THE INVENTION

The present invention provides a stacked electrical connector assembly for mounting on a circuit board, which is economical of circuit board space and in which no further connector is needed for use in electrically connecting the posts of the upper connector to the circuitry on the board.

A stacked electrical connector assembly for mounting on a circuit board, comprises, according to present invention, an upper connector having a mating face and a rear face and electrical terminals arranged in at least one row, each terminal having a connecting post projecting from said rear face; a lower connector having a mating face and a bottom face for engaging the circuit board and electrical terminals arranged in at least one row, each terminal having a connecting post projecting from said bottom face for insertion through a respective hole in the circuit board; at least one bracket mechanically securing the upper connector to the lower connector in superposed relationship, and a flexible cable having conductors each electrically connecting a respective post of the upper connector to a respective post of the lower connector whereby said connectors are wired in parallel.

Since the terminals of the upper connector are wired in parallel with those of the lower connector by way of the flexible cable, the number of holes that must be drilled in the circuit board and the space that is needed to mount the stacked connector assembly to the circuit board are both reduced, only a single footprint on the circuit board being needed.

A margin of the flexible cable will lie against the bottom face of the lower connector, each conductor being preferably soldered to the respective post of the lower connector by means of a high melting point solder, so that when these posts are soldered to the circuitry on the circuit board, the high melting point of solder does not reflow, although such reflow can, under some circumstances, be tolerated.

The posts of each of the upper and lower connectors may be arranged in a plurality of superposed rows, the conductors of the flexible cable, which is preferably a flat, flexible, etched film cable, being configured so as to connect each post of each row of posts of the upper connector to a corresponding post of the corresponding row of posts of the lower connector. For maximum contact density, the posts of one row of each connector, are staggered, or offset, with respect to the posts of the next adjacent row, the conductors or traces of the flexible cable take a circuitous path around plated through holes to provide a trace-to-annular ring clearance on both margins of the cable or etched film in order to allow for this arrangement of the posts.

DESCRIPTION OF THE PREFERRED EMBODIMENT

Figure 1:
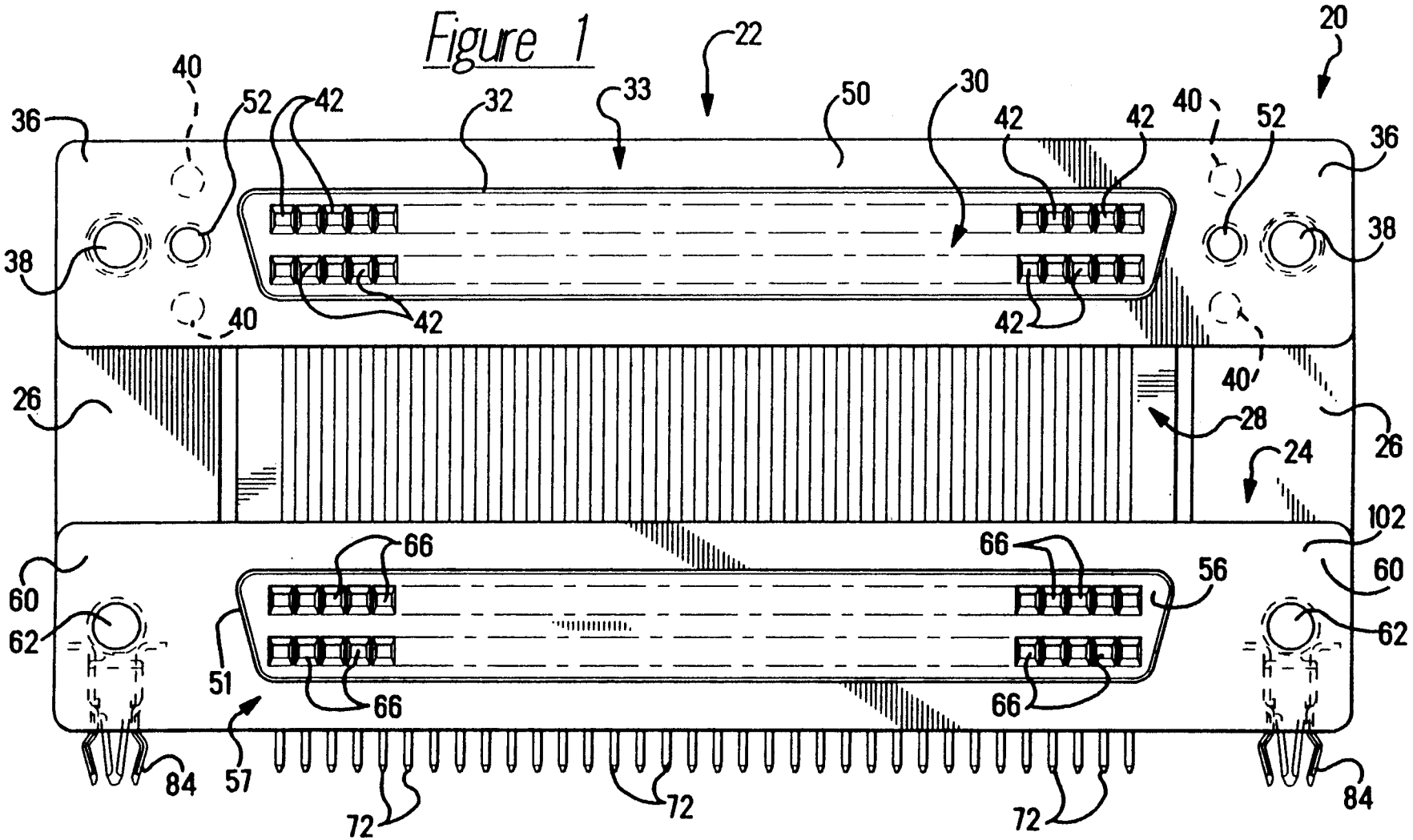
FIG. 1 is a front view of a stacked electrical connector assembly for mounting on a printed circuit board, each connector comprising a front metal shield.

A stacked electrical connector assembly 20 for mounting on a circuit board CB comprises an upper electrical connector 22, a lower electrical connector 24, a pair of metal space brackets 26, and a flat, flexible, etched film cable 28.

The upper connector 22, which is a standard straight posted connector, comprises an elongate, insulating housing 30 having a mating forward face 32, and a rear face 34. Upper connector 22 mates with a complementary first mating connector (not shown). There are received in two superposed rows of cavities 42 in the housing 30, respective rows of electrical terminals each having a mating portion (not shown) which is accessible to a respective mating contact element of said first mating connector, by way of the mating face 32. Each terminal has, extending from its mating portion, a connecting post 44 projecting from the rear face 34 of the housing 30.

Connector 22 has a shield or shell 50 surrounding the upstanding D-shaped portion of housing 30. A housing member 33, which in the preferred embodiment is die-cast zinc, surrounds housing 30 and is electrically commoned with shield or shell 50 in accordance with the teaching of U.S. Pat. No. 4,808,125, the disclosure of which is hereby incorporated by reference. Housing member 33 has a pair of laterally projecting mounting flanges 36, each having a tapped hole 38 for receiving a bolt (not shown) for securing the connector 22 to a complementary first mating connector (not shown)- There opens into the rear face of each flange 36, a pair of tapped holes 40, as indicated in broken lines in FIG. 1.

Figure 2:
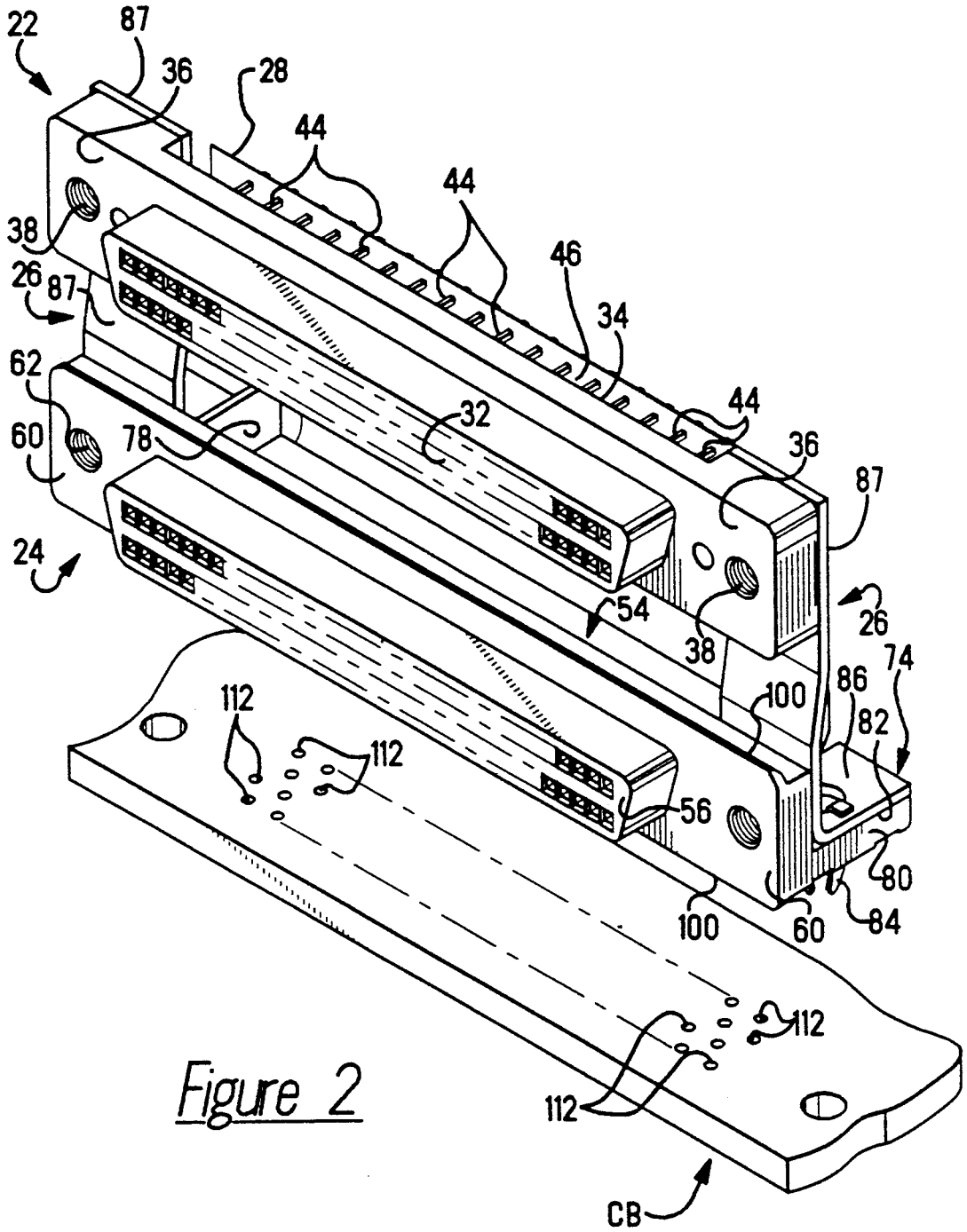
FIG. 2 is an isometric view of the assembly positioned for mounting on the circuit board, the shield or shell of the connectors surround the upstanding Dshaped shroud.

As shown in FIG. 2, the rear face 34 is forwardly offset with respect to the rear faces of the flanges 36 to provide a rearwardly opening recess 46 between the flanges 36. In the interest of contact density, alternate ones of the posts 44 of the bottom row of terminals are also staggered in recess 46, alternate posts 44 of the top row are bent upwardly in the recess 46, whereby rectilinear, free ended connecting portions 48 of the posts 44 extend rearwardly of the housing 30, in the preferred embodiment, beyond the plane of the rear faces of flanges 26, in four superposed parallel rows normal to face 34. A metal shield 50 (FIG. 1) surrounds the mating face 32 and as described above.

Figure 3:
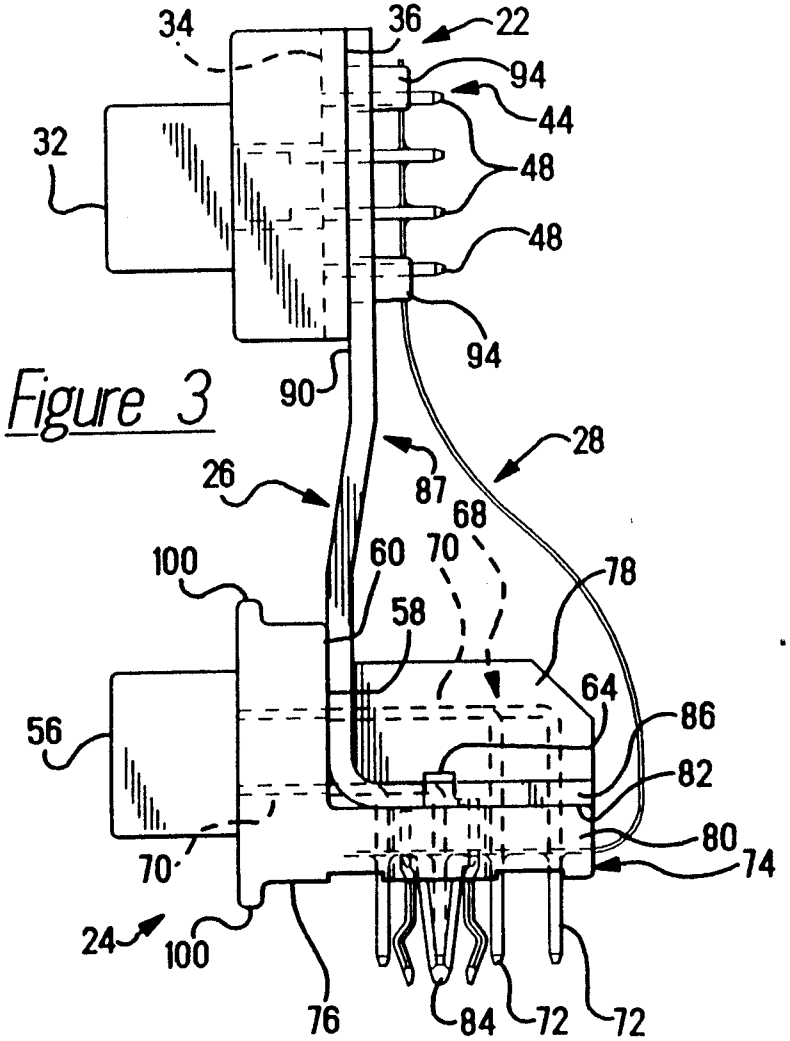
FIG. 3 is a side view of the stacked electrical connector assembly.

Housing member 33 may be secured to flanges 36 by means of fasteners 52 or die cast posts 94 (FIGS. 3 and 4) may be deformed to provide retention.

The lower connector 24 is a standard right angle connector comprising an elongate insulating housing 54, having a mating forward face 56 and a rear face 58. There are received in two superposed parallel rows cavities 66 in the housing 54, electrical terminals having mating portions (not shown) which are accessible to respective mating contact elements of the second mating connector by way of the mating face 56. Each of these terminals has, extending from its mating portion, a post 68 having a rectilinear portion 70 projecting from the mating portion of the terminal rearwardly of the housing 54 and normally of the face 58.

Connector 24 has a shield or shell 51 surrounding the upstanding D-shaped portion of housing 54. A housing member 57, which in the preferred embodiment is die-cast zinc, surrounds housing 54 and is electrically commoned with the shield or shell in accordance with the teaching of U.S. Pat. No. 4,808,125. Housing member 57 has a pair of laterally projecting mounting flanges 60 formed with tapped holes 62 for receiving bolts (not shown) for securing a complementary second mating electrical connector (not shown) to the connector 24. There depends from each post portion 70, a rectilinear, free ended connecting portion 72 bent down at right angles with respect to the post portion 70 and extending through a respective notch (not shown) in a planar bottom flange 74 which projects rearwardly from the housing 54. The housing 54 and flange 74 have a bottom mounting surface 76 below which the portions 72 of the posts 68 extend. The portions 70 and 72 of the posts 68 are contained between barriers 78 standing from the flange 74. The flange 74 has at each end thereof a bracket receiving part 80 having an upper, bracket receiving surface 82 formed with a hole therethrough for receiving a boardlock 84 should that be needed for securing the housing 54 to the circuit board CB. The housing member 57 has upper and lower longitudinally extending ribs 100 for engagement by reversely bent edge portions of a metal shield 102 surrounding the mating face 26.

Be it noted that the portions 70 of alternate posts 68 of the top row of posts 68 are of different length, the portions 70 of alternate posts 68 of the bottom row also being of different lengths and the portions 72 of the posts 68 project from the bottom surface 76 in four rows and to an equal extent. The spacing between the rows of posts portions 72 of the posts 68 project from the bottom surface 76 in four rows and to an equal extent. The spacing between the rows of post portions 72 and the relative arrangement thereof is the same staggered footprint as that of post portions 48 projecting from the rear face 34 to the housing 22. The spacing between the portions 72 of each row is equal and is equal to the spacing between the post portions 48 of the corresponding row thereof. In other words, the posts portions 72 are arranged in exactly the same array or footprint as the post portions 48.

Each bracket 26, which has been stamped from a single piece of sheet metal stock, comprises a planar bottom mounting flange 86 having a hole 88 therethrough for receiving a respective boardlock 84, such as the boardlock disclosed in U.S. Pat. No. 4,842,552 the disclosure of which is hereby incorporated by reference, or if the boardlocks are not needed, a hole for receiving other known retention means. An upstanding portion 87 extends from and is integral with the forward end of flange 86 of each bracket 26. The upstanding portion 87 is substantially the same width as the flange 86 as well as the rear face of each flange 36. The upstanding portion 87 has a lower part 92 connected to the flange 86 and an upper connector mounting part 90 which is slightly rearwardly offset from the lower part 92. The upstanding portion 87 is formed with through holes aligned with holes 38 and 62.

Figure 5:
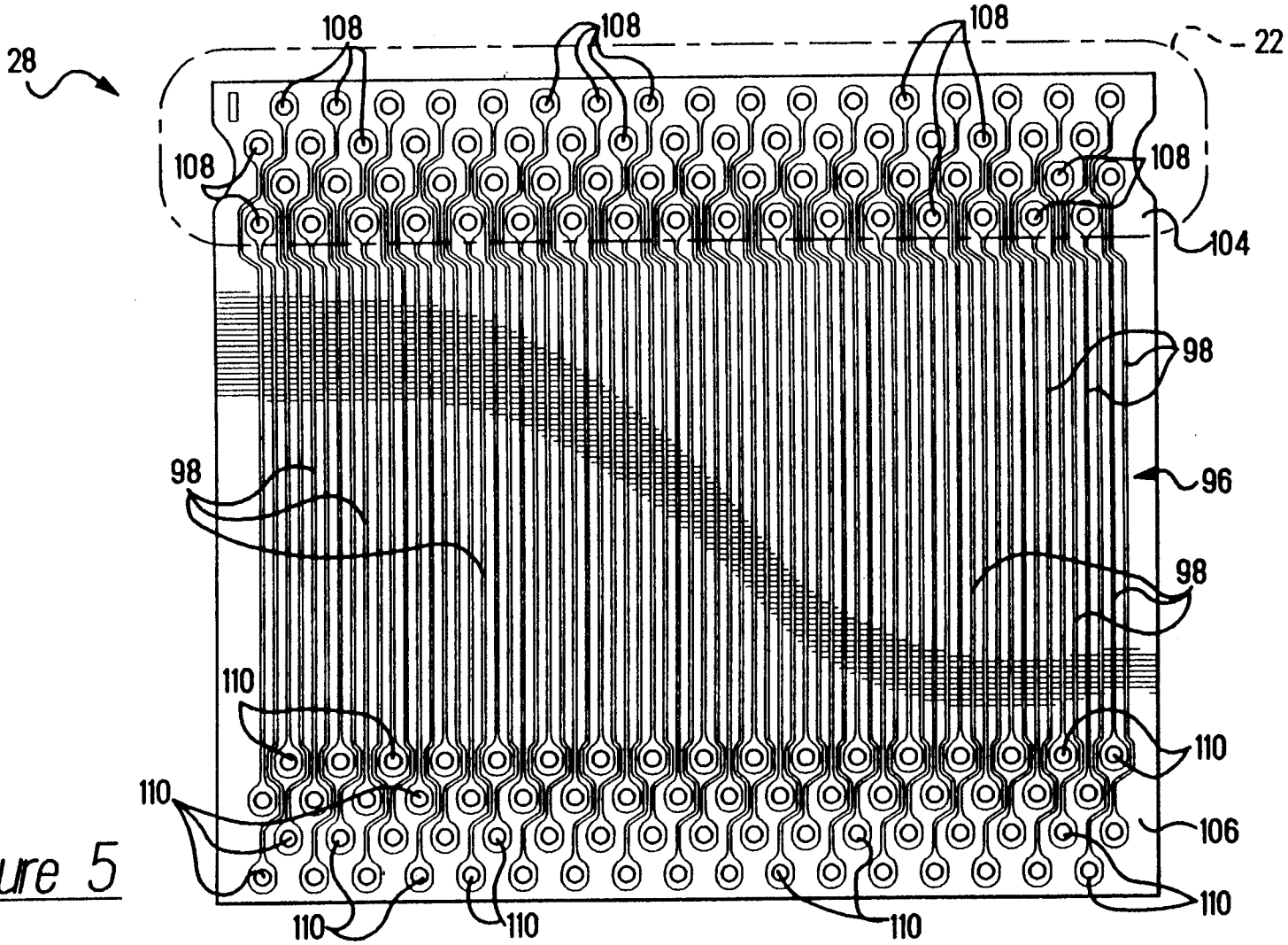
FIG. 5 is a plan view of a flat, flexible cable which is comprised in the stacked electrical connector assembly.

The flat, flexible, etched circuit or form cable 28, which is best seen in FIG. 5, comprises a substantially rectangular base film having thereon conductors in the form of electrically conductive traces 98. The base film 96 has an upper margin 104 and a lower margin 106. Each trace 98 terminates on the margin 104 in an eyelet 108, which forms an annular ring around a through hole, and on the margin 106 in an eyelet 110, which forms an annular ring around a through hole. The holes in the eyelets 104 and 110 open into opposite faces of the base film 96. Between the margins 104 and 106, the traces 98 are parallel with each other, but the traces take a circuitous path to provide a trace —to—annular ring clearance on the margins 104 and 106. The traces and are so dimensioned thereon that the eyelets of each margin are arranged in four rows, the eyelets of each pair of adjacent rows being staggered or offset from each other transversely of the rows of eyelets. Each eyelet 108 of the top row of eyelets 108 is connected by way of its respective trace 98 to the corresponding opposite eyelet 110 of the top row of eyelets 10 on the margin 16. Each eyelet 108 of the first row from the top of the rows of eyelets 108 is connected by way of its respective trace 98, to the corresponding opposite eyelet 110 of the first row from the top of the rows of eyelets 110. Each eyelet 108 of the second row from the top of the rows of eyelets 108 is connected by way of its respective trace 98 to the corresponding opposite eyelet 110 of the second row from the top of the rows of eyelets 110. Each eyelet 108 of the bottom row of the rows of eyelets 108 is connected by way of its respective trace 98 to the corresponding opposite eyelet 110 of the bottom row of eyelets 110.

The number, the relative arrangement, and the spacing between the connecting portions 48 of the posts 44 of the upper connector 22 are identical with the number, the relative arrangement, and the spacing between the eyelets 108. The number, the relative arrangement, and the spacing between, the connecting portions 72 of the post 68 of the connector 24 are identical with the number, the relative arrangement, and the spacing between, the eyelets 110.

In order to construct the stacked connector assembly 20, each eyelet 108 of the cable 96 is threaded onto a connecting portion 48 of a respective post 44 of the connector 22 and each eyelet 110 of the cable 96 is threaded onto the connecting portion 72 of a respective post 68 of the connector 24, the margin 106 of the cable 96 being received in a recess in the bottom face 76 of the housing 54 and its flange 80. The eyelets 108 and 110 are then soldered to the respective connecting portions 48 and 72 of the posts 44 and 68 respectively. Each post 44 of the upper connector 22 is thereby electrically connected by way of a respective trace 98, to a corresponding post 68 of the lower connector 24. Each flange 36 of the upper connector 22 is secured to the mounting part 90 of a respective bracket 26 and the flange 86 of each bracket 26 is secured to the upper surface 82 of a respective flange 80 of the lower connector 24. The connectors 22 and 24 are thereby fixedly stacked in superposed, vertically spaced and vertically aligned relationship.

Figure 4:
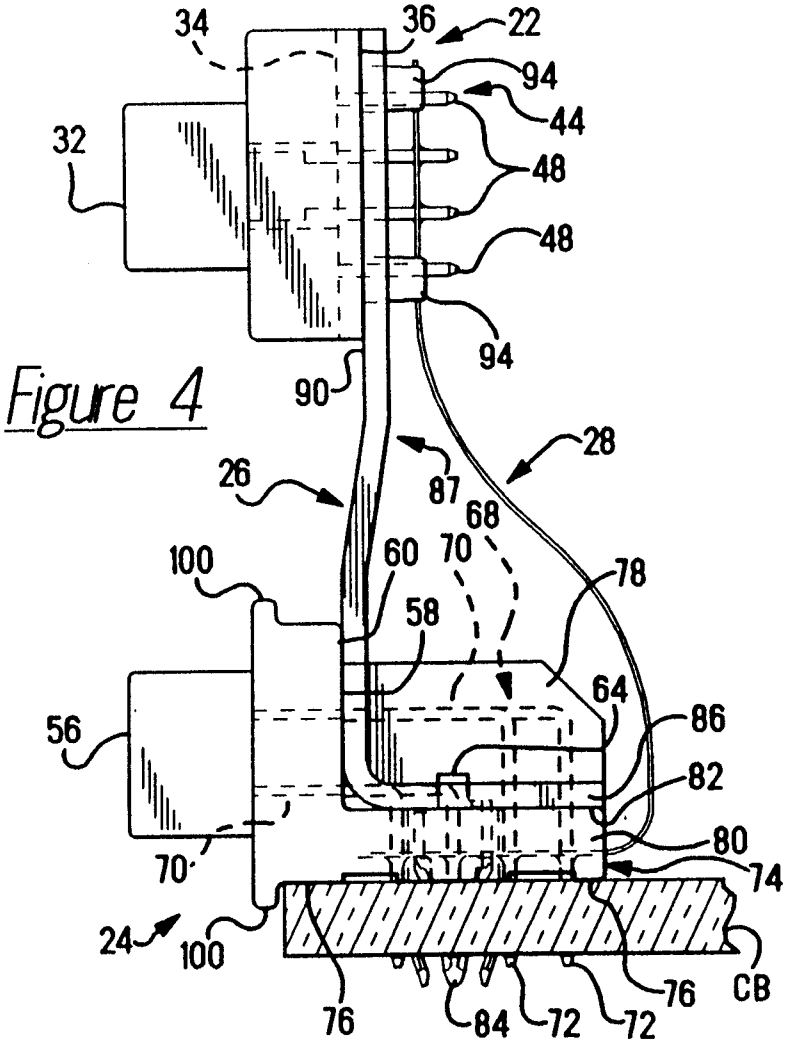
FIG. 4 is a similar view to that of FIG. 3 but showing the connector assembly mounted on the circuit board.

Subsequently, as shown in FIG. 2, the circuit board CB has been drilled and prepared to provide four rows of plated through holes 112, the number, the relative arrangement, and the spacing between the holes 112 being identical with the number, the relative arrangement, and the spacing between, the connecting portions 72 of the posts 68. Apertures positioned to receive the boardlocks are also required when boardlocks are present. In use of the assembly 20, the customer inserts each post portion 72 through a respective hole in the circuit board CB as shown in FIG. 4, until the bottom face 76 of the lower housing 54 and its flange 80, engage against the circuit board CB, as shown in FIG. 4. The customer then solders, typically by means of a wave soldering operation, the post portions 72 to circuitry (not shown) on the board PCB.

During this soldering operation, the solder connecting the eyelets 110 of the post portions 72 may reflow. The stated reflow is not detrimental as flexible etched circuit 28 is retained over connecting portions 72 between connector 24 and the circuit board. The trace-to-connecting portion 72 solder joints are remade upon reflow soldering. If such reflow is not desired the eyelets 110 may, during the construction of the assembly 20, be soldered to the post portions 72 by means of a high temperature solder, that is to say the solder having a high melting point, which will not reflow during the operation of soldering the post portions 72 to the circuitry on the circuit board CB.

The soldered connections between the post portions 72 and the circuit board CB may be sufficient to secure the connector assembly 20 to the board. Boardlocks 84 have tails that fold over the flange 86 to secure connector 24 to bracket 26 and the circuit board CB. Since the terminals of the upper connector 22 are wired in parallel with those of the lower connector 24, by way of the cable 28, as described above, the number of holes that must be drilled in the circuit board and the space thereon required for mounting the connector assembly 20 to the board are both reduced such that only a single footprint on the circuit board is being needed. No means other than the cable 28 are required for connecting the terminals of the upper connector to the circuitry of the circuit board by way of the connecting portions 72 of the posts 68.

We claim:

1. A stacked electrical connector assembly, comprising: an upper connector and a lower connector wired together by conductive traces on a flat flexible cable, a bracket having an upper part to which the connectors are directly connected, conductive posts on each of said connectors, each of the conductive traces extending from a conductive post of the upper connector directly to a conductive post of the lower connector, a connecting portion of each post on the lower connector being connected directly to one of the conductive traces, the connecting portion being adapted for connection to a circuit board, thereby to connect one of the conductive traces between one of the posts on the upper connector and the circuit board, the lower connector having a flange, a bottom mounting surface on the flange, a bracket receiving surface on the flange, the bracket having a lower part secured to the bracket receiving surface on the flange, and the entire bracket extending in superposed vertically aligned relationship with the lower connector for economy of circuit board space.

2. A stacked electrical connector assembly as recited in claim 1 wherein, the posts on the lower connector are bent downward, the connecting portions of said posts on the lower connector extend downward, and the flat flexible cable extends from the posts on the upper connector downward and then transversely to intersect the connecting portions of the posts on the lower connector.

3. A stacked electrical connector assembly as recited in claim 1 wherein, the conductive posts are arranged in eight rows, each of said connectors containing four of said rows, and each conductive trace crosses three of said rows to connect between a post on the upper connector and a post on the lower connector.

4. A stacked electrical connector assembly as recited in claim 1 wherein, the conductive traces are connected to respective posts on the lower connector with relatively high temperature solder to resist reflow of the solder when said respective posts are connected by lower temperature solder to a circuit board.

5. A stacked electrical connector assembly as recited in claim 1 wherein, the mounting bracket is offset transversely to offset the upper connecting from the lower connector.

6. A stacked electrical connector assembly as recited in claim 5 wherein, the posts on the lower connector are bent downward, the connecting portions of said posts on the lower connector extend downward, and the flat flexible cable extends from the posts on the upper connector downward and then transversely to intersect the connecting portions of the posts on the lower connector.

7. A stacked electrical connector assembly as recited in claim 5 wherein, the conductive posts are arranged in eight rows, each of said connectors containing four of said rows, and each conductive trace crosses three of said rows to connect between a post on the upper connector and a post on the lower connector.

8. A stacked electrical connector assembly as recited in claim 5 wherein, the conductive traces are connected to respective posts on the lower connector with relatively high temperature solder to resist reflow of the solder when said respective posts are connected by lower temperature solder to a circuit board.

* * * * *